United States Patent [19]

Maruyama

[11] Patent Number: 4,945,734

[45] Date of Patent: Aug. 7, 1990

[54] FABRIC TENSIONING DEVICE IN A DOUBLE CYLINDER CIRCULAR KNITTING MACHINE

[75] Inventor: Kakuji Maruyama, Bunsui, Japan

[73] Assignee: Nagata Seiki Kabushiki Kaisha, Tokyo, Japan

[21] Appl. No.: 411,710

[22] Filed: Sep. 22, 1989

[30] Foreign Application Priority Data

Sep. 26, 1988 [JP] Japan ..... 63-240313

[51] Int. Cl.[5] ..... D04B 15/88

[52] U.S. Cl. ..... 66/149 R; 66/149 S; 66/147

[58] Field of Search ..... 66/147, 149 R, 149 S

[56] References Cited

U.S. PATENT DOCUMENTS

| | | | |
|---|---|---|---|
| 3,214,944 | 11/1965 | Kienel | 66/149 R |
| 3,750,426 | 8/1973 | Lonati | 66/149 R |
| 3,797,280 | 3/1974 | Lonati | 66/149 R |
| 4,142,384 | 3/1979 | Wood | 66/149 S |
| 4,407,145 | 10/1983 | Lonati | 66/149 R |
| 4,516,410 | 5/1985 | Lonati | 66/149 R |
| 4,576,019 | 3/1986 | Keel et al. | 66/149 S |

FOREIGN PATENT DOCUMENTS

| | | | |
|---|---|---|---|
| 0095445 | 11/1983 | European Pat. Off. | 66/147 |
| 718780 | 11/1966 | Italy | 66/149 R |
| 63-75156 | 4/1988 | Japan . | |
| 2037329 | 7/1980 | United Kingdom | 66/147 |

*Primary Examiner*—Werner H. Schroeder
*Assistant Examiner*—John J. Calvert
*Attorney, Agent, or Firm*—Ladas & Parry

[57] ABSTRACT

A knitwork tensioning device has a fabric locking mechanism normally disposed in the lower needle cylinder of a double cylinder circular knitting machine. The fabric locking mechanism has a set of locking fingers capable of fluid pressure actuation for locking the fabric being knitted against the bottom end of an inner movable tube within the upper needle cylinder. The fabric locking mechanism is itself capable of fluid pressure actuation for movement into the upper needle cylinder. Locked against the inner movable tube by the locking fingers, the fabric is stretched as the fabric locking mechanism travels with the inner movable tube up into the upper needle cylinder under fluid pressure. The upper needle cylinder has also mounted therein an outer movable tube slidably fitted over the inner movable tube. The outer movable tube can be lowered into locking engagement with the fabric for holding the same under tension, so that the knitting operation can be continued when the fabric locking mechanism, after completing its upward stroke, is retracted back into the lower needle cylinder for reengaging the fabric at its lower part.

7 Claims, 6 Drawing Sheets

FABRIC TENSIONING DEVICE IN A DOUBLE CYLINDER CIRCULAR KNITTING MACHINE

BACKGROUND OF THE INVENTION

This invention relates to knitting machines, and more particularly to circular knitting machines of the double cylinder type suitable for the production of stockings, socks and like tubular hosiery or garments. More particularly, the invention deals with provisions in such a double cylinder circular knitting machine for drawing and holding under tension the fabric being fashioned.

The double cylinder circular hosiery knitting machine is per se well known in the art. It comprises an upper and a lower rotatable needle cylinder each carrying a set of needles and disposed upstandingly, in end-to-end relation with each other, to form stitches therebetween. The fabric being knitted is drawn by suction into the upper needle cylinder.

Usually, the knitting machine of this general character includes a device for drawing up and holding under tension the knitwork being formed, in order to avoid stitch irregularities, among other purposes. Japanese Unexamined Patent Publication No. 63-75156 describes and claims an example of such knitwork drawing device.

This prior art device comprises a fabric locking assembly having a set of retractable locking fingers and itself disposed within the lower needle cylinder for movement in its axial direction into and out of the upper needle cylinder. For such movement of the fabric locking assembly an air cylinder is provided which is mounted vertically within the lower needle cylinder and which has an elongate, hollow piston rod coupled at one end to the fabric locking assembly. The other end portion of the hollow piston rod is slidably fitted over a fixed air nozzle. The air cylinder when extended moves the fabric locking assembly into close engagement, via the fabric being knitted, with the bottom end of an inner movable tube concentrically nested within the upper needle cylinder. The upper needle cylinder also accommodates an outer movable tube which is slidably fitted over the inner movable tube for relative axial displacement.

Following the fabric engagement by the fabric locking assembly against the bottom end of the inner movable tube, air under pressure is supplied through the air nozzle into the hollow piston rod and thence into the fabric locking assembly. So actuated pneumatically, the fabric locking assembly has its locking fingers spread apart for additionally locking the fabric against the inside surface of the inner movable tube.

Both air cylinder and fabric locking mechansim are maintained pressurized during the progress of knitting. Consequently, the fabric locking assembly travels up with the inner movable tube into the upper needle cylinder under air pressure, thereby stretching the fabric being formed. The outer movable tube within the upper needle cylinder, on the other hand, is pneumatically lowered in step with the ascent of the inner movable tube for depressing the fabric.

A primary objection to this known knitting machine is the complexity of its construction and operation. During knitting, not only must the upper and lower needle cylinders and the inner and outer movable tubes be synchronously rotated about a common axis, but also the inner and outer movable tubes must be axially moved in the opposite directions. The fabric tensioning device must also operate in step with such complex movements of the various machine components for imparting tension to the fabric being knitted.

Another objection is that the fabric locking assembly substantially airtightly closes the bottom end of the inner movable tube upon locking the fabric against it. Consequently, suction becomes no longer exerted on the fabric received in the inner movable tube.

An additional disadvantage of the prior art manifests itself when the article to be produced is longer than the allowed stroke of the fabric locking assembly. The locking assembly must then temporarily release the fabric and must be lowered to the initial position for reengaging a lower part of the fabric. The prior art device has been incapable of holding the fabric stretched during such fabric reengagement, so that the operation of the knitting machine has had to be suspended. Such suspensions of knitting operation not only decreases the production of the machine but can also gives rise to uneven stitches through a difference in tensile force exerted before and after each suspension.

SUMMARY OF THE INVENTION

The present invention aims at the provision of an improved device in a double cylinder circular knitting machine which holds the knitwork stretched under constant tension as it is formed and which, at the same time, does not interfere with the exertion of suction on the knitwork. The invention also seeks to realize the continuous operation of the knitting machine during the reengagement of an elongate article by the fabric locking mechanism included in the stretching device.

Stated briefly, the invention provides, in a double cylinder circular knitting machine, the combination comprising an upper and a lower needle cylinder disposed end to end and defining a stitching zone therebetween. The upper needle cylinder has an inner and an outer movable tube concentrically nested therein for axial displacement relative to each other and to the upper needle cylinder. Normally disposed within the lower needle cylinder for movement into and out of the upper needle cylinder, fabric locking means has a set of locking members capable of fluid pressure actuation for locking a fabric being knitted against one end of the inner movable tube at the stitching zone. For actuating the fabric locking means there is provided fluid-actuated tandem cylinder means including a first and a second piston member movable into and out of end-to-end abutment against each other, with the second piston member being hollow and being coupled to the fabric locking means in fluid pressure communication therewith. Also included is shift means coupled to the outer movable tube for moving the same into locking engagement with the fabric at the stitching zone preparatory to the retraction of the fabric locking means from the upper to the lower needle cylinder.

The tandem cylinder means is provided with three ports for the admission of pressurized fluid needed for actuation of the fabric locking means and of the locking members.

Shortly after the commencement of knitting operation, the tandem cylinder means admits pressurized fluid through a first port in order to move the first piston member over a first predetermined stroke and hence to move, via the second piston member, the fabric locking means to the stitching zone between the two needle cylinders. Approximately concurrently with the travel of the fabric locking means to the stitching zone, the tandem cylinder means admits pressurized fluid through a second port, with the result that the pressurized fluid is directed through the hollow in the second piston member into the fabric locking means for actuating the locking members into engagement with one end of the inner movable tube means within the upper needle cylinder via the fabric at the stitching zone.

The pressurized fluid thus admitted into the tandem cylinder means via the second port also acts, after the locking members have locked the fabric against the inner movable tube, on the second piston member to move the same over a second predetermined stroke. With this movement of the second piston member, the fabric locking means travels with the inner movable tube a corresponding distance into the upper needle cylinder thereby drawing the fabric and holding the same under tension as stitch formation proceeds at the stitching zone.

Then, as the fabric locking means travels into the upper needle cylinder a distance determined by the stroke of the second piston member, the tandem cylinder means admits pressurized fluid through a third port in order to cause the second piston member to retract the fabric locking means into the lower needle cylinder after releasing the fabric. Then the tandem cylinder means is repressurized to cause the fabric locking means to reengage a lower part of the fabric at the stitching zone.

The use of the tandem cylinder means for driving the fabric locking means as above stated is preferred by reason of the reliability of its operation. For instance, upon initial delivery of pressurized fluid into the tandem cylinder means through the first port, the second piston member travels the exact distance required for moving the fabric locking means to the stitching zone, making it possible for the locking members to positively lock the fabric against the inner movable tube being held in position within the upper needle cylinder.

Preparatory to the retraction of the fabric locking means from the upper to the lower needle cylinder, the noted shift means operates to move the outer movable tube within the upper needle cylinder into locking engagement with the fabric at the stitching zone. Accordingly, as the fabric is thus maintained under tension by the outer movable tube, the knitting operation need not be suspended during fabric reengagement by the fabric locking means. Thus maintained under constant tension throughout the process of its fabrication, the fabric will be knitted with much less stitch irregularities than heretofore.

It is also to be appreciated that the invention utilizes only the locking members of the fabric locking means for locking the fabric against the bottom end of the inner movable tube within the upper needle cylinder. The locking members permits the exertion of suction on the fabric through the inner movable tube even when the fabric is locked. The fabric can therefore be held constantly drawn up within the inner movable tube.

The above and other features and advantages of this invention and the manner of realizing them will become more apparent, and the invention itself will best be understood, from a study of the following description and appended claims, with reference had to the attached drawings showing a preferred embodiment of the invention.

DESCRIPTION OF THE PREFERRED EMBODIMENT

Figure 1:
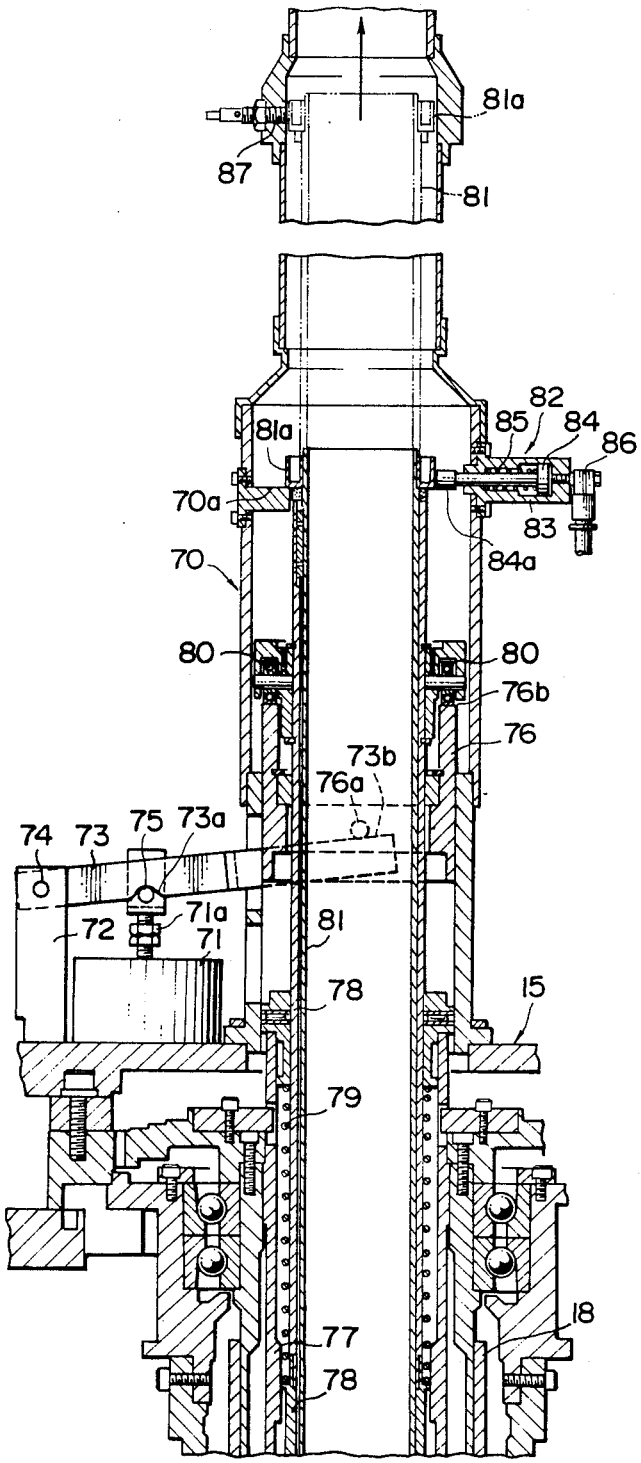
FIG. 1 is a fragmentary axial section through the upper needle cylinder of a double cylinder circular knitting machine incorporating the knitwork stretching means of this invention.
Figure 2:
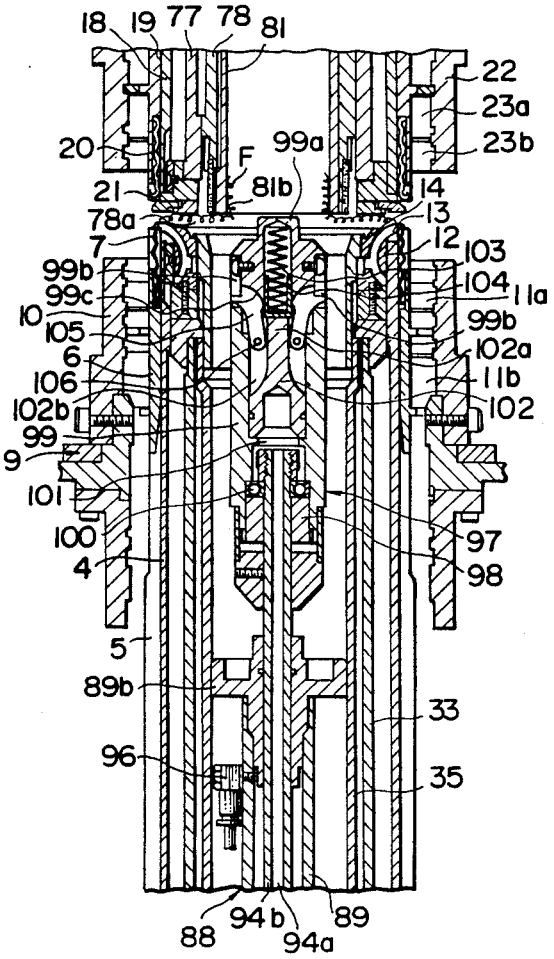
FIG. 2 is a fragmentary axial section through the lower needle cylinder of the knitting machine of FIG. 1, shown together with part of the upper needle cylinder, the view also showing the fabric locking mechanism retracted into the lower needle cylinder.
Figure 3:
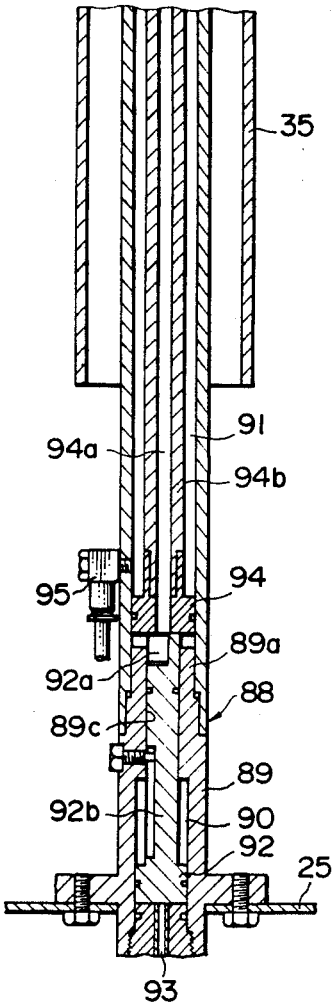
FIG. 3 is a fragmentary axial section through the tandem cylinder assembly extending downwardly from the lower needle cylinder of FIG. 2, the tandem cylinder assembly being also shown in part in FIG. 2.

The knitwork tensioning device of this invention will now be described more specifically as incorporated in a double cylinder circular knitting machine for the production of stockings or like hosiery. The knitting machine of exemplary construction, including a preferred form of knitwork tensioner according to the invention, is shown in FIGS. 1–3 as broken up into three fragments for illustrative convenience. It will nevertheless be seen that the knitting machine comprises an upper needle cylinder 18, shown mostly in FIG. 1, and a lower needle cylinder 4 shown in part in FIG. 2. The two needle cylinders 4 and 18 are disposed coaxially and end to end, defining therebetween a stitching zone where a fabric F is knitted.

The lower needle cylinder 4 of the knitting machine vertically and rotatably extends through a middle table 9 which is in fixed relation to the frame, not shown, of the machine. Tubular in shape, the lower needle cylinder 4 has a plurality or multiplicity of guide grooves 5 defined in its outer surface so as to extend parallel to its axis. Sliders 6 and lower knitting needles 7 are slidably engaged in the guide grooves 5.

Rigidly erected on the middle table 9 is a cam holder 10 of tubular shape concentrically surrounding the lower needle cylinder 4. The cam holder 10 holds cams 11*a* and 11*b* on its inside surface. A sinker ring 12 is mounted inside the top end portion of the lower needle cylinder 4. This sinker ring supports lower sinkers 13 which are swung by a sinker cam 14.

Thus the lower needles 7 on the lower needle cylinder 4 coact with upper needles 20 on an upper needle cylinder 18, yet to be described, for knitting a fabric or knitwork F. The lower sinkers 13 with the sinker cam 14 assist such knitting of the fabric in the known manner.

As shown partly in FIG. 1 and partly in FIG. 2, the upper needle cylinder 18 of tubular shape is disposed coaxially above the lower needle cylinder 4 for rotation in synchronism therewith. The upper needle cylinder 18 is supported in position by an upper table 15 which is rigidly joined to the unshown machine frame. A plurality or multiplicity of guide grooves 19 are also formed in the outer surface of the upper needle cylinder 18, with each guide groove extending parallel to its axis. Upper needles 20 and upper sinkers 21 or verge bit are engaged in these guide grooves 19 against the possible accidental detachment.

FIG. 2 indicates at 22 a cam holder of tubular shape concentrically sleeved upon the upper needle cylinder 18. The cam holder 22 supports cams 23*a* and 23*b* therein for moving the sliders of the upper needles 20 up and down.

FIG. 1 shows a tubular housing 70 erected on the upper table 15. Also, on the upper table 15, a suitable linear actuator such as an air cylinder 71 is mounted upstandingly for driving a shift lever 73. Pivoted at 74 on a column 72 mounted fast on the upper table 15, the shift lever 73 has a bifurcated free end 73*b* for abutting engagement with pins 76*a* on a movable sleeve 76 slidably received within the housing 70. A recess 73*a* at a midpoint of the shift lever 73 engages a pin 75 on the piston rod or output shaft of the air cylinder 71. It is thus seen that the air cylinder 71 drives the movable sleeve 76 axially with respect to the housing 70 via the shift lever 73.

As will be seen from both FIGS. 1 and 2, the upper needle cylinder 18 has a guide tube 77 rigidly mounted therein. Slidably and coaxially disposed within the guide tube 77 are an outer movable tube 78 and, further within this movable tube, an inner movable tube 81. A helical compression spring 79 acts between guide tube 77 and outer movable tube 78 for biasing the latter downwardly. The outer movable tube 78 rotatably carries an annular row of rollers 80 in rolling contact with the top edge 76*b* of the movable sleeve 76. The outer movable tube 78 has a downward extension 78*a*, FIG. 2, of elastic material, preferably a plastic, extending downwardly therefrom for holding down part of the fabric F being knitted.

Thus, as the movable sleeve 76 travels up and down relative to the housing 70, so does the outer movable tube 78 resting on the movable sleeve via the rollers 80. The axial position of the outer movable tube 78 is so shifted by the noted air cylinder 71 between the position of FIGS. 1 and 2 and that of FIG. 7 for the purposes that will become apparent as the description proceeds. This air cylinder 71 will therefore be hereinafter referred to as the shift cylinder. It will be seen that the elastic downward extension 78*a* of the outer movable tube 78 has its bottom end disposed approximately flush with that of the upper needle cylinder 18 when the outer movable tube is in the FIGS. 1 and 2 position.

With reference again to FIG. 1 the inner movable tube 81 has a collar 81*a* formed adjacent its top end for engaging a stop 70*a* on the housing 70, thereby to be prevented from falling down. The housing 70 also supports a brake mechanism 82 adjacent the stop 70*a* for frictionally engaging the outer surface of the inner movable tube 81 and hence for arresting its movement relative to the housing as required.

The brake mechanism 82 comprises a brake actuator herein shown as an air cylinder 83 (hereinafter referred to as the brake cylinder) of the single acting, spring return type mounted horizontally to the housing 70. The brake cylinder 83 houses a piston 84 and a return spring 85. A brake shoe 84*a* is attached to the projecting end of the piston rod for frictionally engaging the inner movable tube 81. The air chamber defined within the brake cylinder 83 by the piston 84 can be placed in and out of communication with a source, not shown, of pressurized air by a valve 86. This valve is to be actuated as required by the knitting program introduced into the electronic control system, not shown, of this machine for locking the inner movable tube 81 against axial displacement with respect to the housing 70.

A proximity switch or like position sensor 87 is provided adjacent the top end of the housing 70. The inner movable tube 81 is to gradually rise from the solid line position of FIGS. 1 and 2 to that indicated by the broken lines in FIG. 1 with the progress of the knitting of the fabric F. When the inner movable tube 81 arrives at this uppermost position, the position sensor 87 is activated by the collar 81*a* on the inner movable tube. The unshown control system responds to the resulting output from the position sensor 87 for controlling the operations of the shift cylinder 71, valve 86 for the brake cylinder 83, and other actuators to be set forth subsequently, as dictated by the predetermined knitting program.

FIG. 2 shows an outer fixed tube 33 and an inner fixed tube 35 concentrically mounted within the lower needle cylinder 4 with clearances. As will be noted from FIG. 3, the inner fixed tube 35 extends downwardly beyond the bottom extremity of the lower needle cylinder 4.

Both FIGS. 2 and 3 illustrate a fluid, preferably air, actuated tandem cylinder assembly 88 for actuating a fabric locking mechanism 97, FIG. 3, yet to be described. The tandem cylinder assembly 88 is erected on a support plate 25, FIG. 3, which forms part of the bed of the knitting machine, and is concentrically received in part in the inner fixed tube 35 within the lower needle cylinder 4.

Included in the tandem air cylinder assembly 88 is a cylinder housing 89 having its top end fluid tightly closed by a sealing member 89*b*. This sealing member 89*b* has a flange held against the inside surface of the inner fixed tube 35 to maintain the cylinder housing 89 in concentric relation thereto. The cylinder housing 89 is partitioned at 89*a* into a relatively short first or lower section 90 and a much longer second or upper section 91.

The shorter lower section 90 of the tandem cylinder assembly 88 slidably accommodates a piston 92 with a piston rod 92*b* slidably extending through a hole 89*c* in the partition 89*a* and partly projecting into the longer upper section 91 of the cylinder assembly. The piston 92 is to be raised by pressurized air fed into the lower cylinder housing section via a port 93.

The longer upper section 91 of the tandem cylinder assembly 88 slidably accommodates a piston 94 normally resting on the top end of the piston rod 92*b* of the lower cylinder section 90. Extending upwardly from the piston 94, a piston rod 94*b* has an air passageway 94*a* formed axially therethrough. A consideration of FIG. 2 will indicate that the piston rod 94*b* slidably but airtightly extends through the sealing member 89*b* and carries on its top end the fabric locking mechanism 97.

The piston 94 is to be moved up and down within the upper cylinder section 91 by pressurized air directed into the pair of air chambers on its opposite sides via ports 95 and 96, besides being lifted by the lower piston 92.

Figure 4:
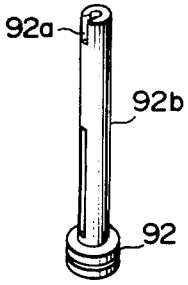
FIG. 4 is a perspective view of the first or lower piston member included in the tandem cylinder assembly of FIG. 3.

As illustrated in detail in FIG. 4, the piston rod 92*b* of the lower cylinder section 90 has a recess 92*a* cut in its top end. Consequently, when the piston 92 is raised together with the piston 94 thereon as depicted in FIG. 5, the pressurized air that has been supplied through the lower port 95 is admitted into the air passageway 94*a* in the piston rod 94*b* of the upper cylinder section 91 via the recess 92*a* in the piston rod 92*b*.

Figure 5:
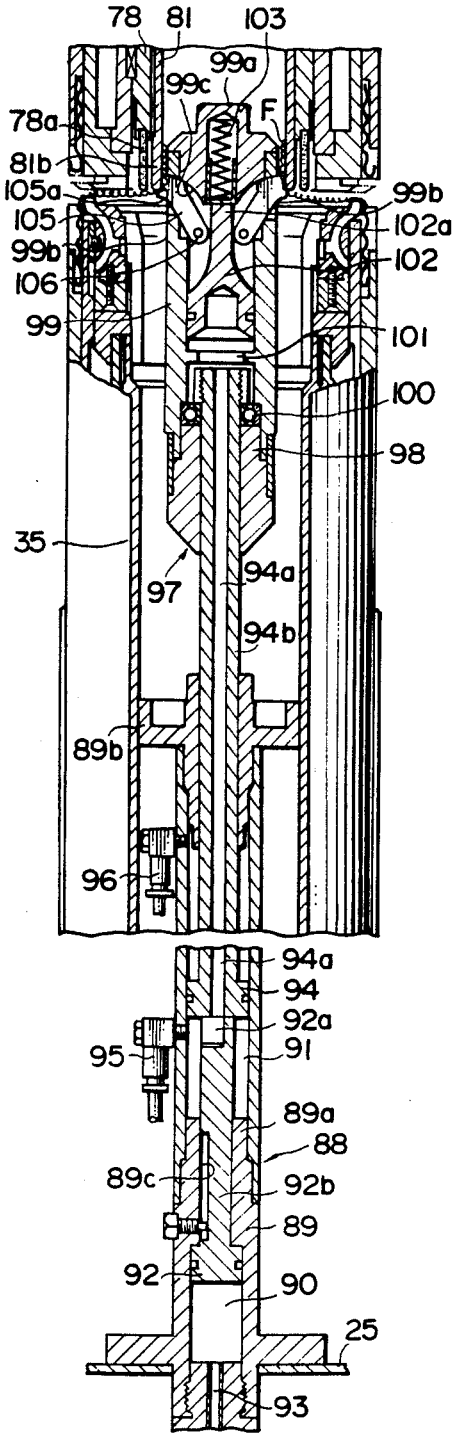
FIG. 5 is a view somewhat similar to FIG. 2 except that the fabric locking mechanism is shown raised to the stitching zone between the upper and lower needle cylinders and locking the fabric against the inner movable tube within the upper needle cylinder.

Reference is now directed to both FIGS. 2 and 5 for a detailed study of the fabric locking mechanism 97 mounted atop the piston rod 94*b* of the tandem cylinder assembly 88. The fabric locking mechanism 97 includes an upstanding air cylinder (hereinafter referred to as the locking cylinder) 99 mounted on a radial expansion 98 formed adjacent the top end of the piston rod 94*b*. A bearing 100 permits rotation of the locking cylinder 99 relative to the piston rod 94*b* about the common axis of the lower and upper needle cylinders 4 and 18.

Slidably mounted within the locking cylinder 99, a piston 102 is shaped in part into ribs 102*b* of cruciate arrangement for serving as a support for a plurality of, four in this embodiment, locking fingers 105 of somewhat curved shape. Each locking finger 105 is pivoted at 106 on the piston 102. Normally held retracted within the locking cylinder 99 as pictured in FIG. 2, the locking fingers project out of openings 99*c* in the end cap 99*a* of the cylinder 99 to the working positions of FIG. 5 upon ascent of the piston 102. As will be seen also from FIG. 5, the outer ends of the locking fingers 105 are contoured for firm engagement of the fabric F against the bottom end 81*b* of the inner movable tube 81 within the upper needle cylinder 18 when the locking fingers are in the working positions. The cylinder end cap 99*a* defines arcuate guide surfaces 99*c* for guiding the locking fingers 105 between the retracted positions of FIG. 2 and the working positions of FIG. 5.

It will therefore be understood that such displacement of the locking fingers 105 result from the reciprocation of the piston 102 of the locking cylinder 99. Essentially, this locking cylinder is of the single acting, spring return type. Received in a spring chamber in the cylinder end cap 99*a*, a return spring 103 butts on the top 102*a* of the piston 102 via a spring seat 104 thereby biasing the piston downwardly of the locking cylinder 99. A port 101 defined in the bottom end of the locking cylinder 99 is open to the air passageway 94*a* in the piston rod 94*b* of the tandem cylinder assembly 88. The air thus forced into the locking cylinder 99 causes upward travel of the piston 102 against the bias of the return spring 103, with the consequent pivotal displacement of the locking fingers 105 from the retracted to the working positions.

Thus the tandem cylinder assembly 88 functions not only to move the complete fabric locking mechanism 97 up and down but also to direct therethrough the pressurized air needed for actuation of the locking cylinder 99. So actuated, the locking cylinder 99 functions in turn to operate the locking fingers 105.

Such being the construction of the illustrated double cylinder circular knitting machine according to the invention, its operation will now be described with emphasis on how the fabric F is stretched and kept under tension while being knitted. However, the operation of the knitting machine will be better understood by first considering its state before, and shortly after, the startup of knitting operation. FIGS. 1–3 illustrate the knitting machine in that state, with the fabric locking mechanism 97 held retracted into the lower needle cylinder 4.

Thus, in FIG. 1, the shift lever 73 is shown turned counterclockwise about its pivot 74 as air under pressure is fed into the shift cylinder 71 under the direction of the unshown programmed control system. The counterclockwise turn of the shift lever 73 results in the upward displacement of the movable sleeve 76 within the housing 70 via the pins 76*a*. Resting on the movable sleeve 76 via the annular row of rollers 80, the outer movable tube 78 is thereby raised against the bias of the compression spring 79 until the bottom end of the elastic downward extension 78*a* of the outer movable tube becomes approximately flush with that of the upper needle cylinder 18 as in FIG. 2.

The fabric F is to be knitted with the outer movable tube 78 in this FIG. 2 position. It is also understood that a partial vacuum is to be created within the inner movable tube 81 for drawing up by suction the fabric F being knitted.

As will be seen also from FIGS. 2 and 3, no pressurized air is introduced into the tandem cylinder assembly 88 until the fabric F gains a certain length. Consequently, the fabric locking mechanism 97 is initially held retracted in the FIG. 2 position under its own weight.

It is also understood that the lower and upper needle cylinders 4 and 18 are conventionally revolved about their common axis during knitting under the command of the programmed control system. The lower needles 7 and upper needles 20 will also operate in the known manner for knitting the fabric F.

The fabric F on being knitted to a certain length will be drawn up as aforesaid into the inner movable tube 81 by suction. Then the control system will command the delivery of pressurized air into the lowermost air chamber of the tandem cylinder assembly 88 via the port 93. Thereupon, as illustrated in FIG. 5, the lower piston 92 will be raised into abutment against the partition 89*a*. Ascending with the lower piston 92, the upper piston 94 will transfer the fabric locking mechanism 97 from the FIG. 2 position to that of FIG. 5.

Then the control system will command the delivery of pressurized air into the port 95 of the tandem cylinder assembly 88. The pressurized air will flow up through the passageway 94*a* in the upper piston rod 94*b* of the tandem cylinder assembly into the locking cylinder 99 of the fabric locking mechanism 97. The result will be the upward travel of the locking cylinder piston 102 against the force of the return spring 103. Traveling upwardly with the piston 102, the locking fingers 105 will spread apart, as guided by the arcuate guide surfaces 99*c*, for engaging the fabric F and locking the same against the lower end 81*b* of the inner movable tube 81 within the upper needle cylinder 18 as in FIG. 5.

With the fabric locking mechanism 97 thus moved to the FIG. 5 position, the bottom opening of the inner movable tube 81 will be greatly reduced in cross sectional area but will nevertheless be sufficiently large to admit the inflow of air at a rate needed for drawing up the fabric F by suction.

The delivery of the pressurized air into the port 95 of the tandem cylinder assembly 88 is to be continued after the locking fingers 105 have locked the fabric F against the lower end of the inner movable tube 81. Such continued delivery of the pressurized air will cause the upper piston 94 of the tandem cylinder assembly 88 to travel upwardly, out of contact with the lower piston rod 92*b*. So raised pneumatically via the upper piston 94, the fabric locking mechanism 97 will in turn raise the inner movable tube 81 relative to the outer movable tube 78 via the locking fingers 105.

Figure 6:
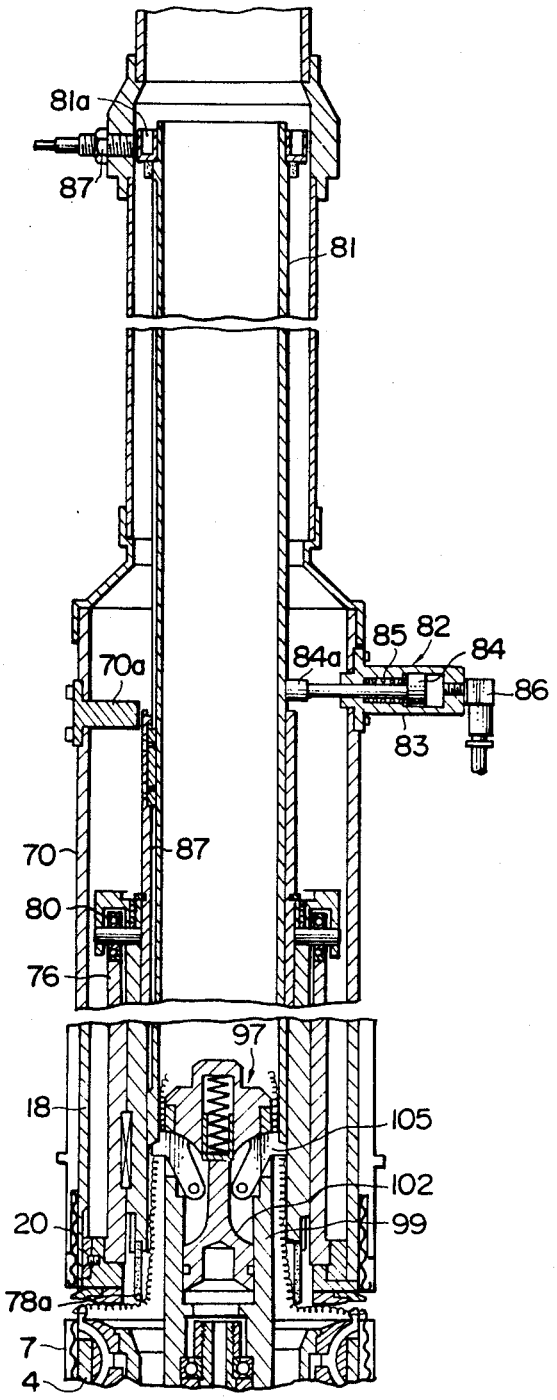
FIG. 6 is a view somewhat similar to FIG. 1 except that the fabric locking mechanism is shown raised into the upper needle cylinder for stretching the fabric being knitted.

FIG. 6 illustrates the fabric locking mechanism 97 thus admitted into the upper needle cylinder 18 for pneumatically drawing up and stretching the fabric F being knitted. Created under tension in this manner, the fabric F will be free from uneven stitches and other defects.

Possibly, the article being knitted may be too long to be drawn to its full length at one stroke of the fabric locking mechanism 97. Tights are an example. In such cases the fabric locking mechanism 97 must temporarily be lowered to the FIG. 1 position for reengaging the fabric F at its lower part. The following is the description of how this is done.

With the progress of knitting operation the inner movable tube 81 is gradually raised, in sliding contact with the outer movable tube 78, by the fabric locking mechanism 97 under the pressure of the air being forced into the tandem cylinder assembly 88 via the port 95. Finally, when the inner movable tube 81 arrives at the predetermined highest position indicated by the broken lines in FIG. 1 and by the solid lines in FIG. 6, the position sensor 87 on the inside surface of the housing 70 will become actuated by the collar 81*a* on the inner movable tube 81.

The control system will respond to the resulting electric signal from the position sensor 87 by causing: (a) withdrawal of the pressurized air from the shift cylinder 71; and (b) actuation of the valve 86 for momentarily placing the brake cylinder 83 in communication with a source, not shown, of pressurized air.

Let us first study what happens upon withdrawal of the pressurized air from the shift cylinder 71. The shift lever 73 will become free to swing clockwise from its FIG. 1 position when the air is vented from the shift cylinder 71. The outer movable tube 78 will then start descending under the bias of the compression spring 79 acting between outer movable tube 78 and guide tube 77. Such descent of the outer movable tube 78 will be transmitted to the shift lever 73 via the annular row of rollers 80 and the movable sleeve 76 thereby causing the shift lever to swing clockwise until it becomes horizontal as drawn in FIG. 7. The outer movable tube 78 has now been shifted to the prescribed lower working position.

Figure 7:
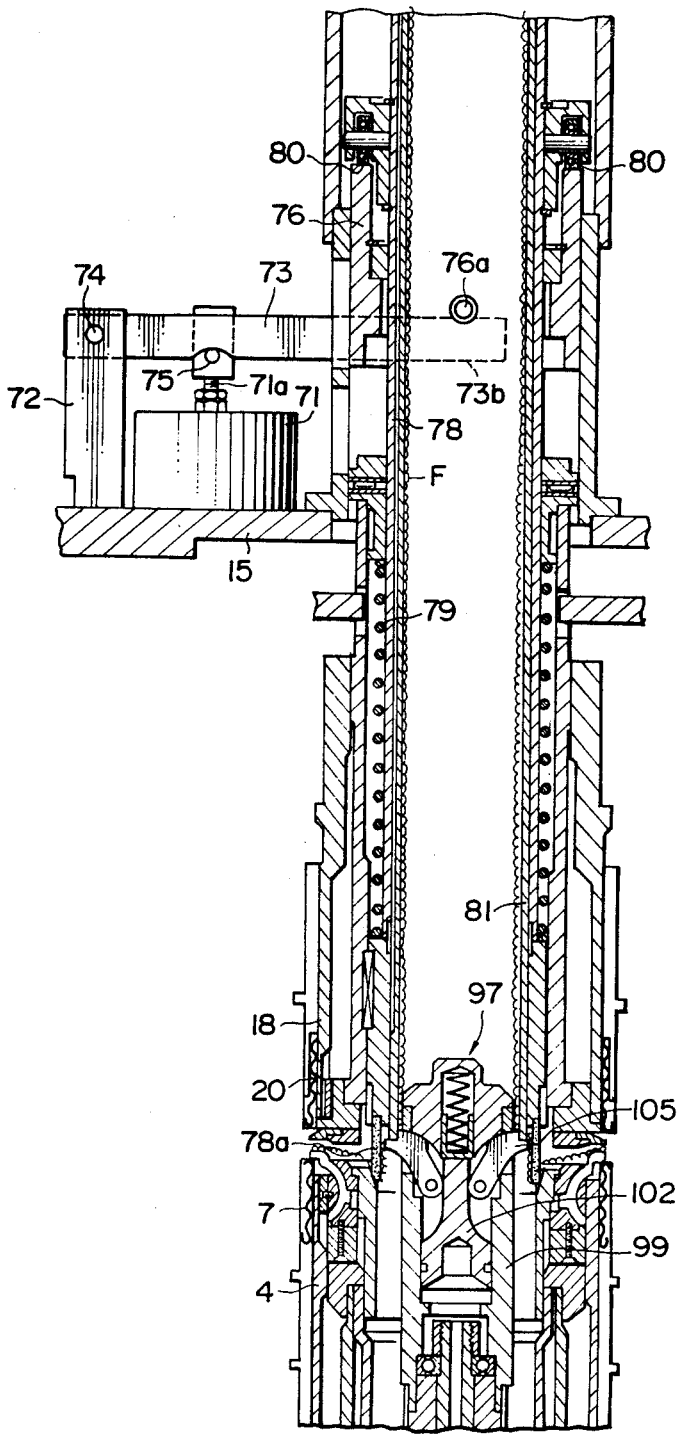
FIG. 7 is also a view somewhat similar to FIG. 1 except that the fabric locking mechanism is shown in the act of reengaging a lower part of the fabric with the progress of knitting operation.

It will be observed from FIG. 7 that, in this lower working position of the outer movable tube 78, the elastic downward extension 78*a* of the tube intrudes into the lower needle cylinder 4. It will also be seen that the fabric F being formed is captured between the elastic extension 78*a* of the outer movable tube 78 and the inside wall of the lower needle cylinder 4. The fabric F can thus be maintained in tension during the process of fabric reengagement by the fabric locking mechanism 97.

As has been mentioned, the control system also causes actuation of the valve 86 in response to the signal from the position sensor 87. The valve 86 on actuation will momentarily place the brake cylinder 83 in communication with the unshown source of pressurized air. The brake cylinder 83 will then extend to engage the inner movable tube 81 with the brake shoe 84*a* thereby locking the inner movable tube against axial displacement. It is understood that the fabric locking mechanism 97 starts descending approximately concurrently with the locking of the inner movable tube 81 by the brake cylinder 83. As the inner movable tube 81 is thus locked against axial displacement, the locking fingers 105 of the descending locking mechanism 97 will readily disengage the fabric F being held against the bottom end of the inner movable tube. The brake cylinder 83 may be vented immediately after the locking fingers 105 have released the fabric F.

Air under pressure has been introduced into the tandem cylinder assembly 88 via the port 95 for causing the ascent of the fabric locking mechanism 97 into the upper needle cylinder 18. Now, for the descent of the fabric locking mechanism 97, the pressurized air may be directed into the tandem cylinder assembly 88 through the upper port 96, with the lower port 95 vented. The fabric locking mechanism 97 will then return to the FIG. 2 position with the consequent descent of the upper piston 94 of the tandem cylinder assembly 88 to the FIG. 3 position. The locking fingers 105 will retract into the locking cylinder 99, as shown also in FIG. 2, as a result of the venting of the locking cylinder via the port 95 of the tandem cylinder assembly 88.

Then, for reengaging the fabric F, pressurized air may be reintroduced into the tandem cylinder assembly 88 via the lowermost port 93. The fabric locking mechanism 97 will then ascend from its FIG. 2 position to that of FIG. 5 as both pistons 92 and 94 of the tandem cylinder assembly 88 are raised pneumatically. Then the middle port 95 of the tandem cylinder assembly 88 may be opened to admit pressurized air into the locking cylinder 99 via the recess 92*a* in the lower piston rod 92*b* and the passageway 94*a* in the upper piston 94 and piston rod 94*b*. So activated, the locking cylinder 99 will operate as above described to cause the locking fingers 105 to reengage the fabric F against the bottom end of the inner movable tube 81 within the upper needle cylinder 18.

Following the fabric reengagement by the fabric locking mechanism 97, the shift cylinder 71 is to be reactuated to cause the outer movable tube 78 to ascend against the force of the compression spring 79. The elastic extension 78*a* of the outer movable tube 78 will then return from its FIG. 7 position to that of FIGS. 2, 5 and 6.

It will be appreciated that the knitting of the fabric F has been continued during the above described process of fabric reengagement by the fabric locking mechanism 97. This unbroken knitting operation is realized as the downward extension 78*a* of the outer movable tube 78 holds the fabric against the inner fixed tube 35 within the lower needle cylinder 4 during the fabric reengagement.

As will be understood by those versed in knitting machines, the illustrated machine of this invention can form the toe and heel portions of stocking articles. The control system programmed for the production of stocking articles will cause the inner movable tube 81 and fabric locking mechanism 97 to their FIG. 2 positions through the above explained procedures for the creation of the toe and heel portions.

It is, of course, understood that the exemplified double cylinder knitting machine is not to impose limitations on the present invention but is subject to a variety of modifications, variations or adaptations within the broad teaching hereof.

What is claimed is:

1. In a double cylinder circular knitting machine, in combination:

(a) an upper and a lower needle cylinder disposed end to end and defining a stitching zone therebetween;

(b) an inner and an outer movable tube concentrically nested within the upper needle cylinder for axial displacement relative to each other and to the upper needle cylinder;

(c) fabric locking means normally disposed within the lower needle cylinder for movement into and out of the upper needle cylinder;

(d) a set of locking members included in the fabric locking means, the locking members being capable of fluid pressure actuation for locking a fabric being knitted against one end of the inner movable tube at the stitching zone;

(e) fluid actuated tandem cylinder means including a first and a second piston member movable into and out of end-to-end abutment against each other, with the second piston member being hollow and being coupled to the fabric locking means in fluid pressure communication therewith;

(f) first port means for admitting pressurized fluid into the tandem cylinder means in order to move the first piston member over a first predetermined stroke and hence to move, via the second piston member, the fabric locking means into the stitching zone;

(g) second port means for admitting pressurized fluid into the tandem cylinder means in order to actuate, via the hollow in the second piston member, the locking members of the fabric locking means into engagement with the one end of the inner movable tube via the fabric after the movement of the fabric locking means into the stitching zone, the pressurized fluid admitted into the tandem cylinder means via the second port means also acting on the second piston member to move the same over a second predetermined stroke and hence to cause the fabric locking means to move with the inner movable tube a corresponding distance into the upper needle cylinder for drawing the fabric;

(h) third port means for admitting pressurized fluid into the tandem cylinder means in order to cause the second piston member to retract the fabric locking means into the lower needle cylinder; and (i) shift means coupled to the outer movable tube for moving the same into locking engagement with the fabric at the stitching zone preparatory to the retraction of the fabric locking means from the upper to the lower needle cylinder.

2. The invention of claim 1 wherein the fabric locking means comprises:

(a) a cylinder housing;

(b) a piston slidably mounted within the cylinder housing and defining therein a fluid chamber and a spring chamber, the fluid chamber being in open communication with the hollow in the second piston member of the tandem cylinder means;

(c) a return spring in the spring chamber;

(d) the locking members being pivotally mounted to the piston and being normally held retracted within the cylinder housing under the force of the return spring;

(e) guide means for guiding the locking members into locking engagement with the inner movable tube upon displacement of the piston under the force of the pressurized fluid in the fluid chamber in opposition to the force of the return spring.

3. The invention of claim 2 wherein each locking member has one end shaped for positive locking engagement with the one end of the inner movable tube via the fabric.

4. The invention of claim 1 wherein the first piston member of the tandem cylinder means has a recess formed therein for communicating the second port means with the hollow in the second piston member when the first and second piston members are in end-to-end abutment against each other.

5. The invention of claim 1 wherein the shift means comprises:

(a) resilient means biasing the outer movable tube into locking engagement with the fabric at the stitching zone; and (b) fluid actuated shift cylinder means for normally holding the outer movable tube out of locking engagement with the fabric against the force of the resilient means.

6. The invention of claim 1 further comprising brake means engageable with the inner movable tube for temporarily locking the same against axial displacement at the time of the retraction of the fabric locking means from the upper to the lower needle cylinder, in order to assure ready disengagement of the locking members from the inner movable tube.

7. The invention of claim 1 further comprising a position sensor to be activated by the inner movable tube when the latter travels with the fabric locking means to a predetermined extreme position away from the lower needle cylinder.

* * * * *